US006629393B2

(12) United States Patent
Pignataro

(10) Patent No.: US 6,629,393 B2
(45) Date of Patent: Oct. 7, 2003

(54) MASONRY REINFORCING TIE

(76) Inventor: James J. Pignataro, 14815 Bobcat Plaza, Fountain Hills, AZ (US) 85268

( * ) Notice: Subject to any disclaimer, the term of this patent is extended or adjusted under 35 U.S.C. 154(b) by 0 days.

(21) Appl. No.: 09/927,477

(22) Filed: Aug. 13, 2001

(65) Prior Publication Data

US 2003/0029123 A1 Feb. 13, 2003

(51) Int. Cl.[7] ..... E04C 5/00

(52) U.S. Cl. ..... 52/677; 52/649.8; 52/649.7; 52/649.6; 52/432

(58) Field of Search ..... 52/442, 712, 677, 52/687, 649.1, 649.8, 679, 432, 649.6, 649.7, 603

(56) References Cited

U.S. PATENT DOCUMENTS

| | | | | |
|---|---|---|---|---|
| 903,000 | A | 11/1908 | Priest, Jr. | |
| 1,899,312 | A | 2/1933 | Cochran | |
| 2,300,181 | A | 10/1942 | Spaight | |
| 2,929,238 | A | 3/1960 | Kaye | |
| 3,059,380 | A | 10/1962 | Holsman | |
| 3,183,628 | A | 5/1965 | Smith | |
| 3,342,004 | A | 9/1967 | Lucas | |
| 3,546,833 | A | 12/1970 | Perreton | |
| 4,190,999 | A | 3/1980 | Hampton | |
| 4,227,359 | A | 10/1980 | Schlenker | |
| 4,229,922 | A | 10/1980 | Clark, Jr. | |
| 4,305,239 | A | 12/1981 | Geraghty | |
| 4,321,779 | A | 3/1982 | Kratchmer | |
| 4,334,397 | A | 6/1982 | Hitz | |
| 4,689,931 | A | 9/1987 | Hodges | |
| 4,726,567 | A | 2/1988 | Greenberg | |
| 4,765,115 | A | 8/1988 | Pollina | |
| 4,769,961 | A | 9/1988 | Gillet | |
| 4,793,104 | A | 12/1988 | Hultberg et al. | |
| 5,056,289 | A | 10/1991 | Colen | |
| 5,099,628 | A | 3/1992 | Noland et al. | |
| 5,193,320 | A * | 3/1993 | Coccagna | 52/442 |
| 5,259,161 | A | 11/1993 | Carter | |
| 5,408,798 | A | 4/1995 | Hohmann | |
| 5,596,857 | A | 1/1997 | Besche | |
| 5,624,211 | A | 4/1997 | Anderson et al. | |

* cited by examiner

*Primary Examiner*—Carl D. Friedman
*Assistant Examiner*—Jennifer I. Thissell
(74) *Attorney, Agent, or Firm*—Richard C. Litman

(57) ABSTRACT

A masonry reinforcing tie is formed of a pair of spaced apart, parallel elongate elements joined by a series of lateral crossmembers welded or otherwise affixed across the elongate members. The elongate elements and crossmembers are preferably formed of heavy metal wire or rod. The elongate members each include a series of spaced apart joint spacing elements formed integrally therewith, with the spacing elements having a height equal to the standard mortar joint thickness between vertically adjacent courses of block or brick. The spacing elements may be any suitable shape, e.g., V, U, square, etc. as desired, and may be laterally aligned with one another, staggered, and/or evenly or unevenly spaced along the elongate elements as desired. The spacers may be formed during manufacture of the tie by passing the tie through a roller die, stamping the spacers along the elongate elements, etc.

3 Claims, 8 Drawing Sheets

MASONRY REINFORCING TIE

BACKGROUND OF THE INVENTION

1. Field of the Invention

The present invention relates generally to brick, block, and masonry construction, and more particularly to a horizontal tie for placement between courses of concrete block, for spacing the adjacent courses evenly. The tie or "ladder" of the present invention includes a series of vertically disposed spacer elements formed integrally with the elongate elements parallel to the masonry courses, with these spacer elements defining the gap between courses and thus providing a consistent thickness for the mortar bond layer between vertically adjacent courses.

2. Description of the Related Art

The construction of walls and similar structures from a series of concrete blocks, bricks, or other elements, requires great skill and technique to achieve perfectly level horizontal courses with consistent spacing between elements in each row or course. Accordingly, the cost of such work is not inexpensive, considering the highly skilled labor generally involved. As a result, many amateurs will economize by attempting such work in home construction projects and the like, with the results generally not as satisfactory as those achieved by professionals.

One of the major reasons for the lack of uniform rows or courses in such brick and block construction, is the difficulty in achieving a constant thickness for the mortar joint between vertically adjacent brick or block courses. The lack of a straight, uniform joint between courses, greatly detracts from the finished appearance of a masonry structure and is perhaps the most obvious sign of imperfection in such a structure, even though the structure may be otherwise sound.

Another problem with masonry construction is the relative weakness of the mortar joints in comparison to the strength of the individual brick or concrete block elements themselves. When a masonry wall is damaged, it is quite often the mortar joints which fail, with the individual brick or block elements remaining intact. As a result, most building codes require some form of reinforcement between courses, or perhaps installed vertically in the spaces within the blocks in concrete block construction. Accordingly, the development and use of various forms of reinforcing members constructed of wire rod, flat sheet elements, or other suitable material, is well known in the art. These devices are commonly known as "ladders," due to their two elongate parallel elements which run along each side of the mortar joint, and the series of crossmembers which tie the parallel elements together. However, these rod and sheet elements are generally considerably thinner than the mortar joint between adjacent horizontal courses in a masonry structure, and do nothing to provide accurate spacing between adjacent courses in such a wall.

Accordingly, a need will be seen for an improved masonry reinforcing tie for use in brick and block masonry structures, but which is particularly well adapted for use in concrete block wall construction. The present reinforcing tie is formed of wire rod, with two elongate elements spaced apart to lie just within the outer edges of the mortar joint between vertically adjacent courses of blocks. The two elongate elements are tied together by a series of spaced apart lateral elements which span the distance between the two elongate elements, i.e., just slightly shorter than the span of the mortar joint. Each of the elongate elements includes a series of spaced apart, vertically disposed spacer elements, which extend out of the plane of the elongate elements a distance equal to the thickness of the mortar joint to be applied.

The present invention is used by applying mortar to the top of a previously completed course of blocks (or to the footing upon which the blocks are to be placed), with the present reinforcing tie then placed into the mortar, with the spacing elements oriented either upwardly or downwardly. The next course of blocks is then set in place atop the fresh mortar and reinforcing tie and tamped into place against the underlying reinforcing tie or spacer elements thereof, to press the tie downwardly into the fresh mortar. The present reinforcing tie thus defines an accurate mortar joint thickness, resulting in an attractively finished wall.

A discussion of the related art of which the present inventor is aware, and its differences and distinctions from the present invention, is provided below.

U.S. Pat. No. 903,000 issued on Nov. 3, 1908 to Stephen Priest, Jr., titled "Wall Tie," describes a reinforcing tie having two longitudinal wires with a series of lateral wires extending therebetween. The lateral wires are twisted together and further twisted about the longitudinal wires, to tie the assembly together. The maximum thickness of the twisted wires is only equal to twice the wire diameter, which is clearly less than the thickness of the mortar joint. The Priest, Jr. tie thus cannot be used to space adjacent masonry courses from one another. It is further noted that as the twisted wires extend substantially the entire length of the longitudinal wire components, that the essentially constant thickness of the twisted pairs would result in separating the mortar on each side of the wire members, thus weakening the joint.

U.S. Pat. No. 1,899,312 issued on Feb. 28, 1933 to Lee Cochran, titled "Burial Vault," describes a construction having a sheet metal case overlaid with reinforcing wire mesh and concrete. The multiple strands of the mesh include a series of U-shaped bends which extend generally normal to the plane defined by the mesh. The spacer elements are welded to the sheet metal case of the assembly, with the mesh being applied to both sides of the metal case. The assembly is then coated with concrete. However, the metal mesh of the Cochran vault does nothing to space one solid element from another, or to define the thickness of the concrete overlay of the metal case, whereas the present reinforcing tie is adapted for use between adjacent masonry courses and defines the distance and mortar thickness therebetween.

U.S. Pat. No. 2,300,181 issued on Oct. 27, 1942 to Harold L. Spaight, titled "Means For Constructing Buildings," describes a masonry tie comprising two elongate wire or rod members with a series of alternating, generally diagonal lateral members therebetween. The Spaight tie cannot serve to evenly space vertically adjacent masonry courses, as no vertical spacer elements are provided by Spaight.

U.S. Pat. No. 2,929,238 issued on Mar. 22, 1960 to Karl H. Kaye, titled "Masonry Joint Mesh-Strip," describes an essentially conventional ladder-type reinforcing tie, having a pair of parallel longitudinal wire rod members connected by a series of lateral members welded therebetween. Kaye provides additional grip for his tie by forming serrations along the upper and lower sides of the longitudinal members in order to better grip the mortar. However, Kaye does not provide any spacer elements extending from the plane of his tie for evenly spacing adjacent courses of masonry, as provided by the present masonry reinforcing tie invention.

U.S. Pat. No. 3,059,380 issued on Oct. 23, 1962 to Henry T. Holsman, titled "Block Wall Reinforcement," describes a tie system having two parallel wires along each block edge, with each longitudinal wire pair joined by a sinusoidal transverse wire. Additional diagonal ties are also provided. However, the maximum thickness of the Holsman tie assembly is no more than two wire diameters and does not extend across the entire thickness of the mortar joint between courses to space those courses from one another, as is clearly shown in FIG. 4 of the Holsman patent.

U.S. Pat. No. 3,183,628 issued on May 18, 1965 to William G. Smith, titled "Masonry Wall Reinforcing Means," describes a reinforcing tie in which the longitudinal members are embossed with a series of grooves or depressions. These grooves perform substantially the same function as that of the serrations of the Kaye '238 U.S. Patent discussed further above, i.e., providing a better grip between the reinforcing tie and the surrounding mortar. However, it is clear from the elevation views in section of FIGS. 3 and 5 of the Smith U.S. Patent, that his tie does not extend completely between the adjacent faces of the blocks of adjacent courses, and thus cannot serve to space those courses accurately from one another to provide a consistent thickness for the mortar joint.

U.S. Pat. No. 3,342,004 issued on Sep. 19, 1967 to Joseph N. Lucas, titled "Masonry Wall Reinforcement With A-Frame Construction," describes a tie system for securing two parallel, adjacent walls together, as in a concrete block wall with a brick veneer. Lucas utilizes two parallel reinforcing bars in the thicker (block) wall, and a single third elongate member in the thinner wall. These longitudinal members are joined by a series of diagonal members to tie the longitudinal members, and the walls, together. However, Lucas teaches away from increasing the thickness of his tie structure, by flush welding the components together so they all lay in the same plane. The resulting, relatively thin assembly cannot span the thickness of the mortar joint between courses, as does the present tie and spacers.

U.S. Pat. No. 3,546,833 issued on Dec. 15, 1970 to Arnold Perreton, titled "Insulated Building Block Construction," describes a concrete block configuration having a front or veneer joined to the block by a pair of webs. An insulating block of material is inserted within the space between the main block and front face portion. Perreton also discloses a conventional ladder type reinforcing tie for his construction, but no means of providing consistent spacing between courses by using the tie, is disclosed by Perreton.

U.S. Pat. No. 4,190,999 issued on Mar. 4, 1980 to Ralph C. Hampton, titled "Locator For Vertical Reinforcing Bars," describes a structure having parallel wires imbedded along the edges of a masonry course. A series of crossmember wires is provided, with each of the crossmembers having a horizontal loop formed therein. The loops provide for the insertion of a vertical reinforcement bar therethrough, with the location of the loops providing precise locating for the vertical bars. The crossmembers also have fingers which extend downwardly into the cavities of the blocks, in order to position the assembly and its vertical bar locating loops precisely. As the downwardly extending fingers of the locator wires are not disposed between the courses of the blocks, they do nothing to establish any form of spacing between the blocks. The present invention provides spacer elements as an integral part of the longitudinal reinforcing members, disposed between the edges of the vertically adjacent block courses in order to define a precise spacing therebetween.

U.S. Pat. No. 4,277,359 issued on Oct. 14, 1980 to Robert W. Schlenker, titled "Adjustable Single Unit Masonry Reinforcement," describes a reinforcing tie having generally diagonal members between two longitudinal members. The diagonals include corrugated wall ties adjustably affixed thereto, which may be positioned as desired. However, the wire frame is no thicker than a single wire member, and the corrugations of the wall ties are no thicker than the single wire thickness of the wire frame. An examination of the elevation views in section of FIGS. 7, 8, and 9 of the Schlenker patent shows that the reinforcement assemblies do not extend completely across the mortar joint between adjacent courses, and thus cannot provide accurate spacing between courses, as provided by the present invention.

U.S. Pat. No. 4,229,922 issued on Oct. 28, 1980 to John E. Clark, Jr., titled "Wall Assembly," describes a reinforcement tie assembly and concrete block configuration adapted specifically for his tie configuration. The Clark, Jr. ties have upwardly projecting extensions from each end of the lateral crossmembers, with the blocks including a series of horizontal grooves for the longitudinal members and vertical grooves for the projecting extensions of the lateral members. Thus, Clark, Jr. teaches away from the present invention, as his blocks are so configured to accept his reinforcement tie to lay flush with the upper surface of one course, and for the upward extensions to engage grooves in the overlying course. No means for providing any spacing between courses, is provided by the Clark, Jr. block and tie assembly.

U.S. Pat. No. 4,305,239 issued on Dec. 15, 1981 to Robin C. Geraghty, titled "Device For Use In Building," describes a flat tie formed of stamped sheet metal, with one or more lugs or ears bent outwardly therefrom for anchoring in a concrete pillar or the like. The lugs have holes therein, for attaching a wire reinforcement tie thereto. The ties are generally conventional, having two longitudinal members and a series of lateral crossmembers. The crossmembers each have a downwardly projecting V-shaped element formed therein, but these elements cannot serve as spacers between courses of blocks, as they are in the area of the conventional hollow center of the blocks when the wall is constructed. Geraghty is silent as to the purpose of these V-shaped elements.

U.S. Pat. No. 4,321,779 issued on Mar. 30, 1982 to James Kratchmer, titled "Wall System Utilizing Interlocking Blocks And Ties," describes a system in which the blocks themselves are specially configured to provide an interlocking structure, rather than relying solely upon ties and mortar. Each of the Kratchmer blocks has a lower groove and a mating upper ridge along each outer edge thereof, with the ridges having intermittent slots therein for lateral tie elements. The ties themselves are relatively short, with the longitudinal members being shorter than the lateral elements. Grooves are provided in the tops of the blocks, for the longitudinal legs of the tie members. Thus, Kratchmer does not use the ties to provide any form of spacing between vertically adjacent courses of blocks, whereas the present ties provide such spacing.

U.S. Pat. No. 4,334,397 issued on Jun. 15, 1982 to George R. Hitz, titled "Masonry Structure And Apparatus And Process For Spacing Block In The Structure," describes a plastic (not metal) spacer element having a series of paired, oppositely projecting prongs extending therefrom. Opposite prongs contact opposite adjacent faces of adjacent courses of blocks, separating the blocks with a predetermined spacing to provide an accurate mortar joint therebetween. However, the Hitz devices are relatively short and are formed of plastic and do nothing to provide additional strength to the wall, whereas the present reinforcement ties also provide additional strength, as well as providing the desired spacing between courses. Moreover, the present reinforcing ties are easily manufactured by forming the desired spacer elements in existing ties, which is not possible with the Hitz spacers.

U.S. Pat. No. 4,689,931 issued on Sep. 1, 1987 to Philip R. Hodges, titled "Masonry Construction Device," describes a device having a pair of parallel, sawtooth configuration arms with a single straight crossmember at one end thereof, forming a squared "U" shape. A single one of the Hodges devices cannot be used as a tie, as the Hodges devices are too short for such use. A series of the Hodges devices must be linked together to span more than a single brick. Moreover, the Hodges device is too small for use with concrete blocks, which are considerably larger than bricks. In contrast, a single one of the present masonry reinforcing ties spans the length of a plurality of concrete blocks, and includes a series of lateral ties thereacross.

U.S. Pat. No. 4,726,567 issued on Feb. 23, 1988 to Harold H. Greenberg, titled "Masonry Fence System," describes a concrete block wall or fence having interlocking ends between horizontally adjacent blocks and using vertical tension rods to add compressive strength to the wall. Greenberg also discloses conventional horizontal single ties (illustrated) and multiple wire, ladder type ties (described in the text), but is silent regarding any means of spacing vertically adjacent horizontal courses of blocks.

U.S. Pat. No. 4,765,115 issued on Aug. 23, 1988 to Peter J. Pollina, titled "Brick Supporting Structures," describes a wire frame structure from which a series of wire brick supports are hung. The supports each fit beneath a single brick, supporting that brick above an underlying brick or footing to establish they proper spacing between bricks for the mortar joint. However, the Pollina brick supports do not rest upon the underlying masonry nor do they extend longitudinally between a plurality of blocks, as is the case with the present reinforcing tie. The Pollina supports require the support of the wire frame structure from which they extend, with the wire frame structure being external to one side of the brick wall, or between courses in a double masonry wall. Pollina does not provide any means of placing a spacer between vertically adjacent courses with the spacer elements contacting facing surfaces of the adjacent courses, whereas the present reinforcing tie contacts both facing surfaces of the vertically adjacent courses to provide proper spacing therebetween.

U.S. Pat. No. 4,769,961 issued on Sep. 13, 1988 to Joseph Gillet, titled "Building Block And Structure Made Therefrom," describes a block having opposite extended and recessed ends for fitting with a series of like blocks to interlock the series horizontally. Gillet states that no mortar is used with his construction, and thus no spacing is provided between horizontally or vertically adjacent blocks. Accordingly, Gillet must provide recesses in the tops of his blocks for clearance for the installation of horizontal ties in his construction, and teaches away from spacing his blocks apart from one another by any means.

U.S. Pat. No. 4,793,104 issued on Dec. 27, 1988 to Jeffrey A. Hultberg et al., titled "Guide For Laying Glass Blocks," describes a spacer having a generally T-shaped configuration, with a series of slotted elements attached thereto. Horizontal and vertical reinforcing rods are placed in the slots during construction of the wall. Thus, the Hultberg et al. device is separate from the reinforcing rods, rather than being formed integrally therewith, as in the spacer elements of the present reinforcing tie. Moreover, Hultberg et al. state that their guide does not directly contact any of the adjacent block surfaces (column 2, lines 62–65), which is confirmed by an examination of the cross section of FIG. 3 of the Hultberg et al. patent. In contrast, the present reinforcing tie is particularly configured to come into direct contact with the facing surfaces of vertically adjacent blocks, in order to space those blocks precisely from one another to achieve a neat and consistent mortar joint therebetween.

U.S. Pat. No. 5,056,289 issued on Oct. 15, 1991 to William J. Colen, titled "Wall Construction And Spacer For Use Therewith," describes various spacer embodiments stamped from sheet metal. A vertical base component has a pair of arms extending therefrom, with the vertical width of the arms defining the spacing between vertically adjacent courses of blocks. Each arm has a distal end which fits into a groove in the specially configured blocks, to tie two adjacent blocks together. The Colen spacer differs considerably from the present invention, in that Colen requires specially configured slotted blocks to receive the distal ends of the arms, and the relatively small sheet metal panels from which the Colen spacers are formed cannot span more than two blocks. Moreover, the Colen spacers are not suitable for use in a wall where both sides are exposed, as the base of each spacer element is exposed on one side of the wall.

U.S. Pat. No. 5,099,628 issued on Mar. 31, 1992 to Jimmy L. Noland et al., titled "Apparatus For Enhancing Structural Integrity Of Masonry Structures," describes an apparatus having a pair of longitudinal wire or rod members with a series of closely spaced lateral members thereacross. Each of the lateral members includes a hook shaped end, but the hooks all lie in the horizontal plane, parallel to the plane of the mortar joint, and do not project upwardly or downwardly for spacing. The cross sectional elevation view of FIG. 5 of the Noland et al. patent clearly shows that the lateral arms are essentially centered in each horizontal mortar joint, and do not contact either of the adjacent courses.

U.S. Pat. No. 5,259,161 issued on Nov. 9, 1993 to Frank P. Carter, titled "Vertical And Horizontal Reinforcement And Spacing Guide For Panels Constructed Of Blocks," describes a system comprising a series of longitudinal metal strips, with the strips having rectangular cross sections and arcuate recesses staggered on opposite sides for mortar adhesion. The strips are installed horizontally and vertically between glass blocks in a wall during construction, with the outer edges of each component contacting the adjacent face of a glass block for spacing the blocks apart from one another. The cutting of the rectangular section Carter reinforcements from relatively thick metal sheet, or forming them from bar stock, and then forming the arcuate cutouts along each opposite edge thereof, results in a relatively costly manufacturing process for the components. In contrast, the present reinforcements are formed of relatively inexpensive rod, with the spacing elements bent into the rods during the manufacturing process. The result is a much more economical construction for the present reinforcing tie.

U.S. Pat. No. 5,408,798 issued on Apr. 25, 1995 to Ronald P. Hohmann, titled "Seismic Construction System," describes a relatively complex series of reinforcing elements for allowing limited movement between two parallel walls. None of the components imbedded in any of the mortar joints of the walls have a thickness greater than two wire diameters, and hence cannot completely span the thickness of a mortar joint for spacing of the joint. Hohmann does not disclose such a feature for his system.

U.S. Pat. No. 5,596,857 issued on Jan. 28, 1997 to Charles F. Besche, titled "Masonry Reinforcement," describes a sheet metal baffle, for placement across the open cores of concrete blocks during construction. The baffle includes depressions therein for capturing mortar along the interface between adjacent courses of blocks. The result is that each course has an essentially continuous layer of mortar therebetween, rather than only along the edges surrounding the hollow cores. However, the Besche device does not extend substantially beyond the length of a single block, and thus does not provide reinforcement per se. Rather, the device provides indirect reinforcement by allowing more mortar to be used between adjacent courses. Moreover, the Besche plate is relatively thin, and does not define the thickness of the mortar joint, as can be seen in FIG. 6 of the Besche patent.

Finally, U.S. Pat. No. 5,624,211 issued on Apr. 29, 1997 to Peter L. Anderson et al., titled "Modular Block Retaining Wall Construction And Components," describes various embodiments having specially configured blocks for installing laterally extending ties therefrom. The Anderson et al. assembly is adapted for use in retaining walls and the like where the wall is not free standing, and does not disclose any form of horizontal ties disposed longitudinally within the wall structure.

None of the above inventions and patents, taken either singularly or in combination, is seen to describe the instant invention as claimed. Thus a masonry reinforcing tie solving the aforementioned problems is desired.

SUMMARY OF THE INVENTION

The present invention is a masonry reinforcing tie comprising two elongate horizontal members secured together by a series of lateral members which span the horizontal members and are secured (welded, etc.) thereto. Such ties are often referred to as "ladders" due to their general appearance, and are placed in the mortar between horizontal courses of blocks or bricks in a wall during construction to strengthen and reinforce the wall. The present reinforcing tie is preferably formed of steel rod or heavy wire, although other materials may be used alternatively.

The present reinforcing tie differs from others of the prior art in that the present tie includes a series of spacer elements formed integrally with each elongate element, with the spacers defining the space or mortar gap between vertically adjacent blocks or bricks. Use of the present reinforcing tie permits a person(s) to lay multiple, vertically stacked courses of blocks or bricks neatly and evenly, assuring that the horizontal mortar joints between vertically adjacent courses are even and consistent.

The spacer elements of the elongate members are preferably formed integrally therewith, by a stamping, rolling, or similar operation at the time of manufacture. The protuberances or spacers stamped or otherwise formed in the elongate wire members may have any suitable shape (V, U, square, etc.) as desired, and may be parallel to one another or staggered along the two elongate members. These elements may be evenly spaced along the lengths of the elongate members, or may be unevenly spaced, as desired.

Accordingly, it is a principal object of the invention to provide a masonry reinforcing tie or ladder for placement between vertically adjacent courses of blocks or bricks during construction, for reinforcing the masonry construction and also for properly spacing the vertically adjacent courses from one another.

It is another object of the invention to provide such a masonry reinforcing tie comprising a pair of spaced apart, parallel elongate heavy wires or rods joined together by a plurality of lateral crossmembers welded or otherwise affixed thereto, with the elongate elements each including a series of spaced apart mortar joint spacer elements normal to the plane defined by the tie.

It is a further object of the invention to provide such a masonry reinforcing tie in which the spacer elements are formed integrally with the elongate elements at the time of manufacture, and which may comprise any of various shapes (e.g. V, U, square, etc.) as desired.

Still another object of the invention is to provide a means of forming the spacer elements in the elongate members at the time of manufacture of the reinforcing tie.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
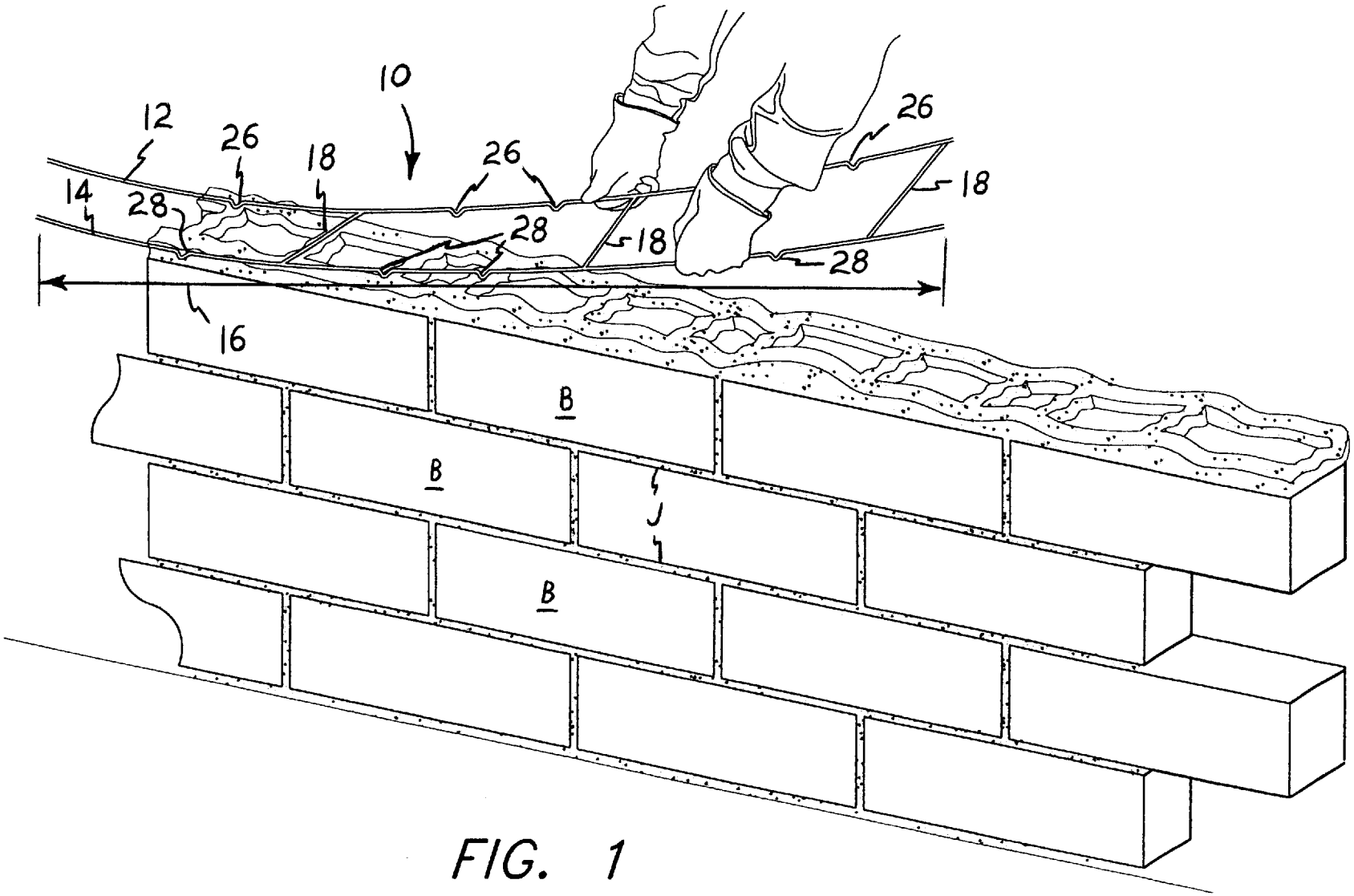
FIG. 1 is an environmental, perspective view of a masonry reinforcing tie according to the present invention, being placed atop a mortared course of blocks during masonry construction.

The present invention comprises a reinforcement tie for use in brick, concrete block, or other masonry element construction. The present tie serves a dual function, by providing additional lateral strength in a masonry wall and also defining a consistent thickness for the horizontal mortar joint between vertically adjacent courses of masonry elements. FIG. 1 of the drawings illustrates the general installation of the present reinforcement tie, designated by the reference numeral 10 throughout the drawings. The masonry tie 10 comprises a first and a second longitudinal member, respectively 12 and 14, each having a length 16 at least equal to two or more (preferably several) masonry blocks or bricks B. Preferably, the present reinforcing tie 10 is provided in lengths of ten feet to extend the length of several blocks, but alternative lengths (eight feet, twelve feet, etc.) may be used as desired.

The two longitudinal members 12 and 14 are interconnected by a series of lateral crossmembers 18, which are spaced apart along the lengths of the two longitudinal members 12 and 14; spacing is preferably even, but the crossmembers 18 may be unevenly spaced if so desired. The crossmembers 18 are all of equal length to one another, to place the two longitudinal members 12 and 14 parallel to one another. Preferably, both the longitudinal members 12 and 14 and the crossmembers 18 are formed of metal, such as a structural steel rod or wire. The crossmembers 18 are rigidly and permanently joined to the longitudinal members 12 and 14 preferably by welding, but any suitable joining method may be used as desired.

Figure 2:
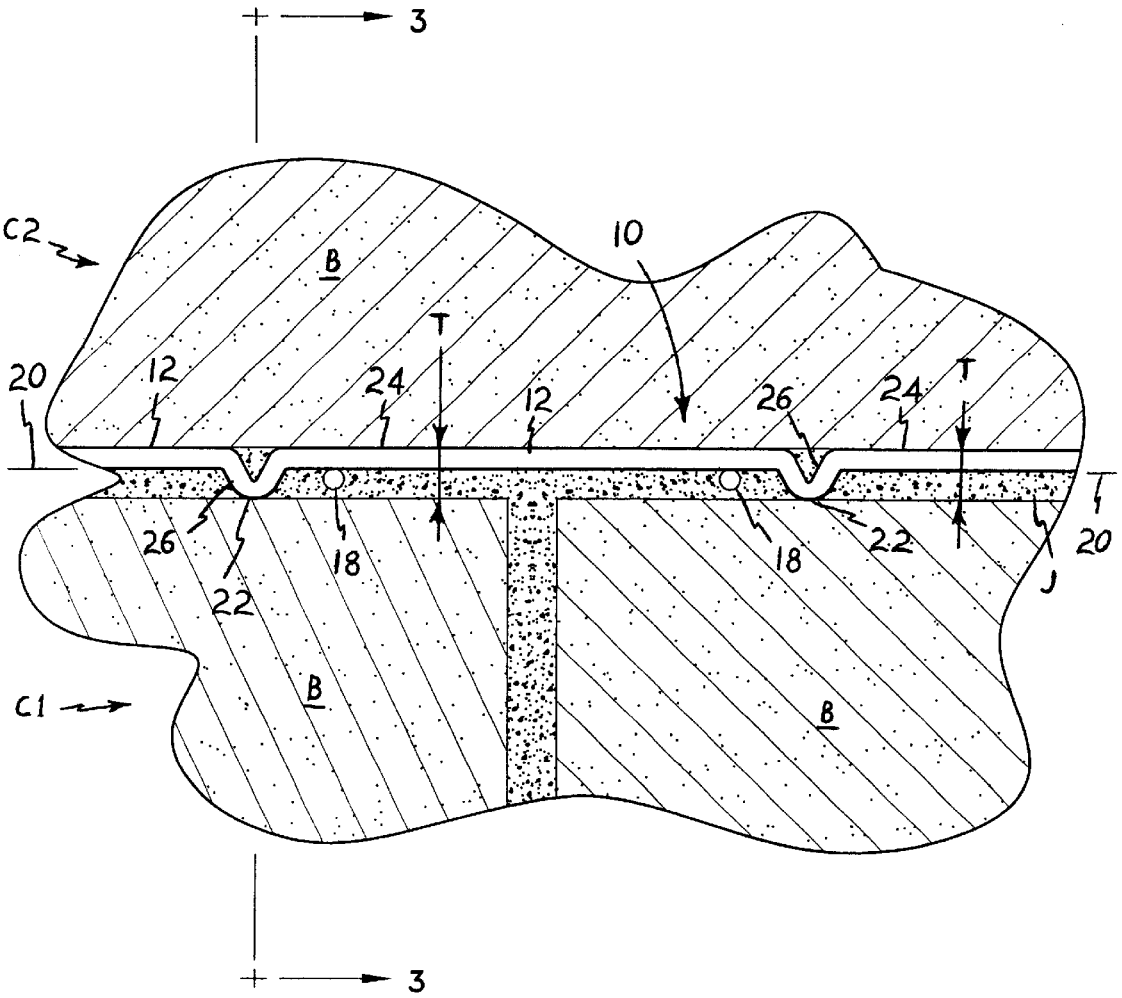
FIG. 2 is a side elevation view in section of a block wall, showing the spacing of vertically adjacent courses of blocks by means of the present reinforcing tie.

FIG. 2 provides a side elevation view in section of a masonry structure formed of a series of masonry elements, e.g., blocks or bricks B, with a first and second horizontal course, respectively C1 and C2, having a mortar joint J disposed therebetween. The longitudinal members 12 and 14, along with the series of crossmembers 18, generally define a reinforcing tie plane 20 with a first side 22 and an opposite second side 24.

The first side 22 of the reinforcing plane 20 comprises a first masonry course contact means, formed of a series of longitudinally spaced or separated first and second spacer elements 26 and 28 (shown in FIGS. 1 and 3) extending respectively from the longitudinal members 12 and 14 and formed integrally therewith. The spacer elements 26 and 28 are preferably formed integrally from their respective longitudinal members 12 and 14, by bending the steel rod members 12 and 14 periodically along their lengths to form the protruding, longitudinally separated spacer elements 26 and 28 extending normal to the reinforcing tie plane 20.

The opposite second side 24 comprises a second masonry course contact means, formed of the longitudinal members 12 and 14 themselves. The two masonry course contact means, i.e., the spacer elements 26, 28 and opposite longitudinal members 12 and 14, are formed specifically to provide sufficient height therebetween to define an accurate and consistent mortar joint thickness T, enabling a worker to place the present reinforcing tie 10 in a horizontal mortar joint J during construction, to establish a neat and consistent mortar joint J between the two courses C1 and C2.

Figure 3:
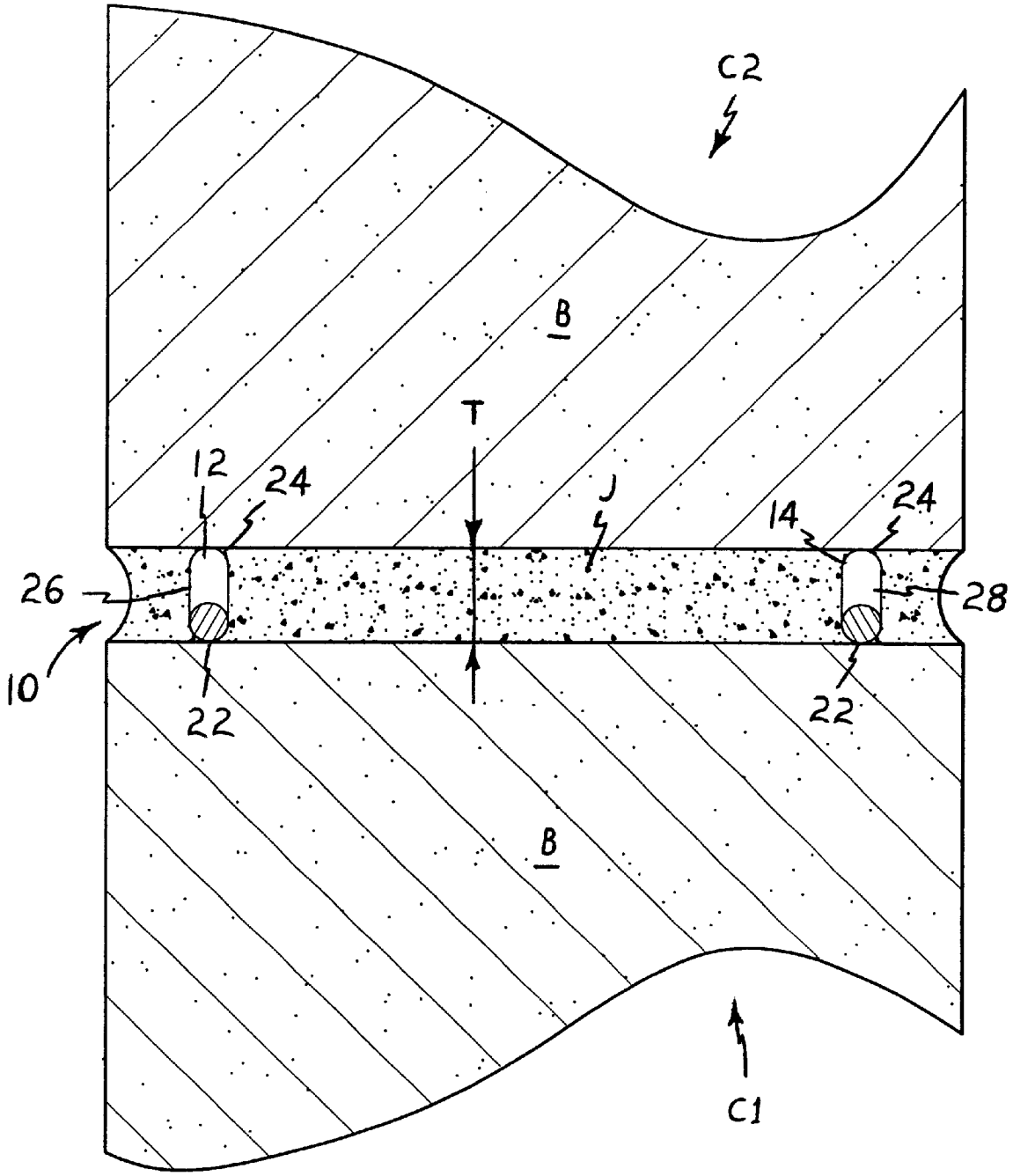
FIG. 3 is an elevation view in section along line 3—3 of FIG. 2, showing the vertical span of the spacing elements of the present reinforcing tie between vertically adjacent courses.

FIG. 3 of the drawings provides an elevation view in section of the present reinforcing tie installation along line 3—3 of FIG. 2. The width of the tie 10 is defined by the lengths of the lateral crossmembers 18, with the tie width preferably being about one and one half inches narrower than the width of the blocks or bricks B with which the present tie 10 is being used. This allows the mortar joint J to be coved along each side, without the reinforcing tie 10 protruding from the edge of the mortar joint J.

Figure 4:
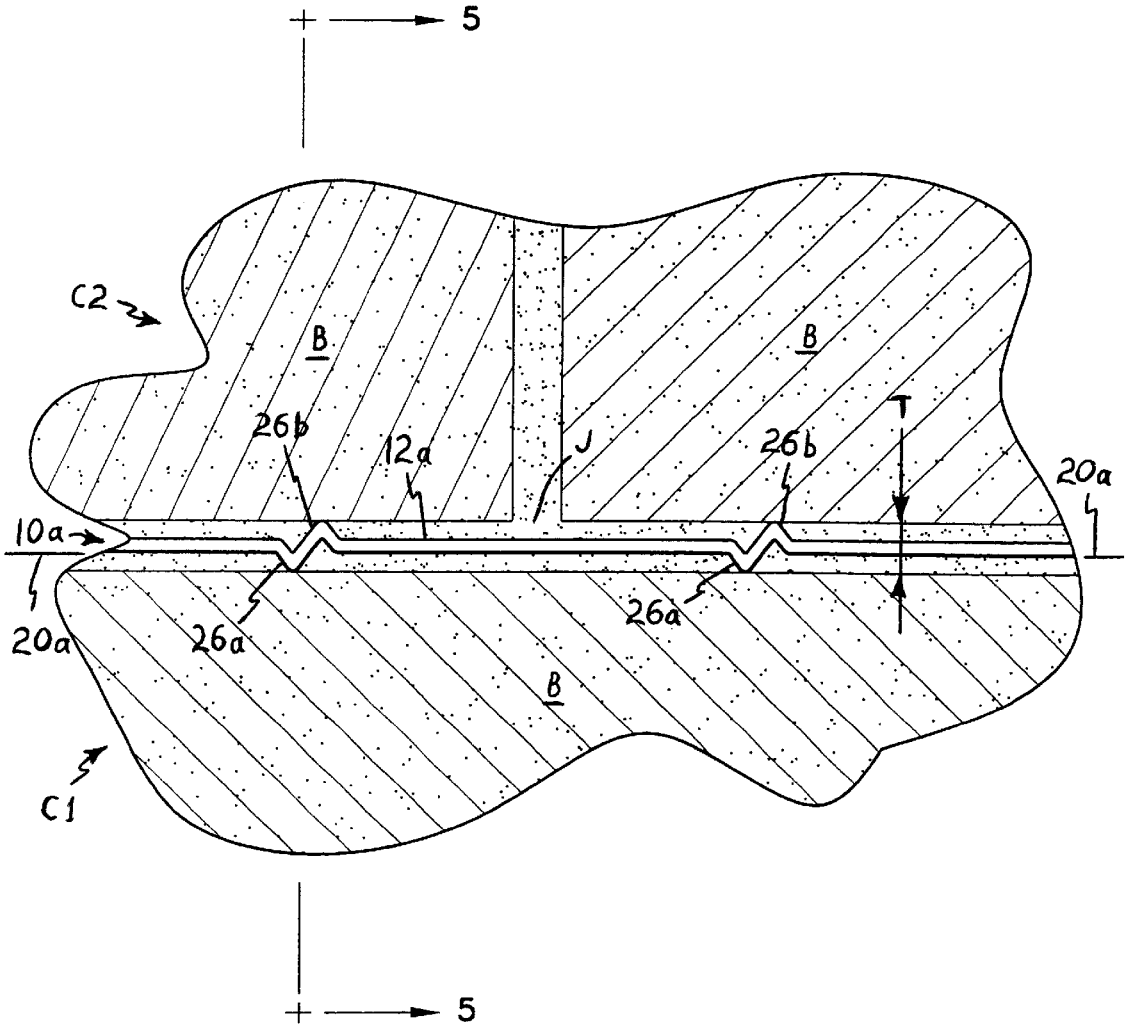
FIG. 4 is a side elevation view in section of a block wall having an alternative embodiment of the present reinforcing tie.
Figure 5:
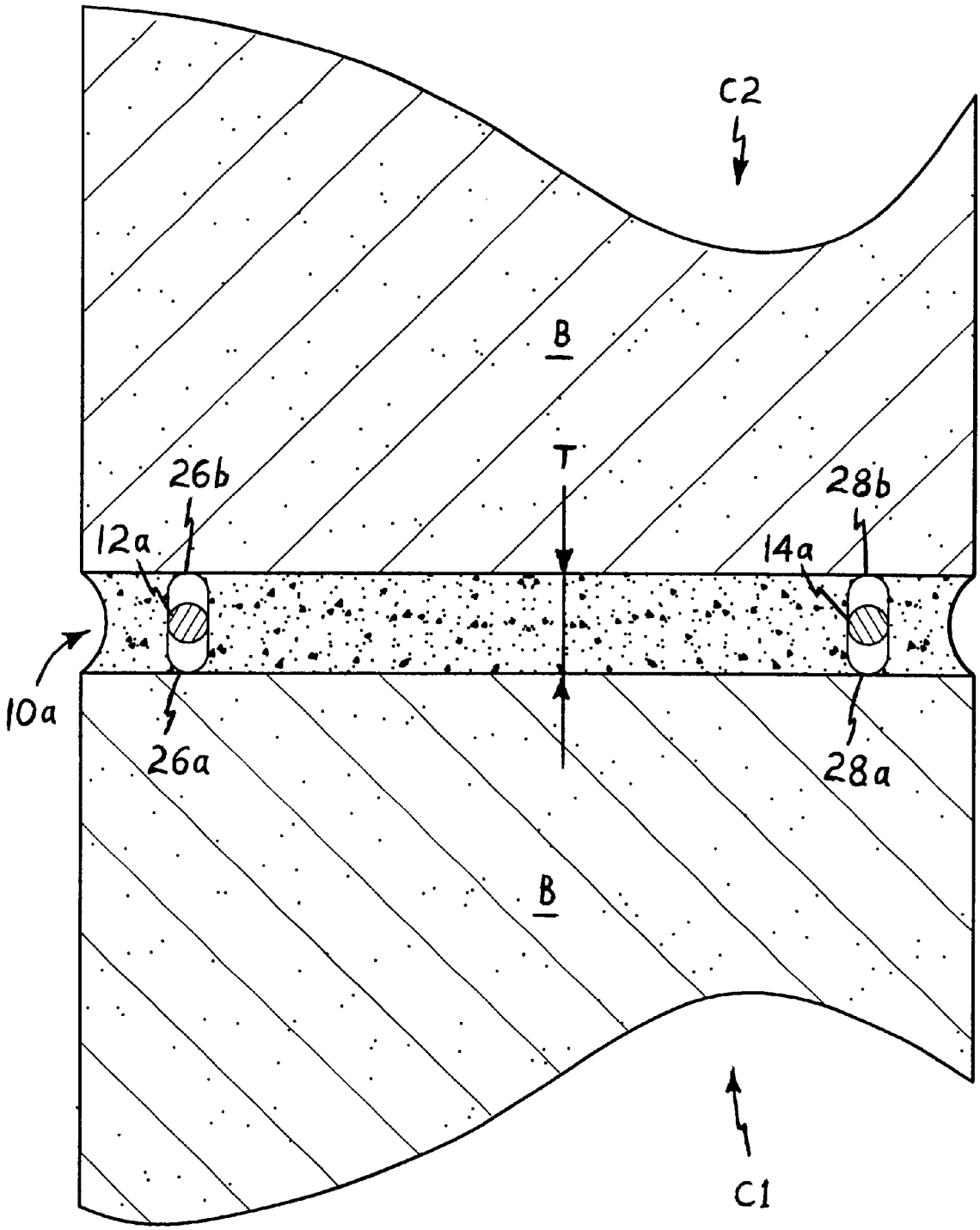
FIG. 5 is an elevation view in section along line 5—5 of FIG. 4, showing an end view of the reinforcing tie of FIG. 4.

FIGS. 4 and 5 of the drawings illustrate an alternative embodiment of the present invention, wherein a reinforcing tie includes spacer elements generally symmetrically disposed along the longitudinal elements, to either side thereof. In FIG. 4, the reinforcing tie 10*a* is installed in a mortar joint J between two vertically adjacent courses C1 and C2 of masonry blocks or bricks B. The tie 10*a* is formed of first and second longitudinal members, respectively 12*a* and 14*a* (14*a* being shown in FIG. 5), connected by a series of lateral members (not shown, but essentially identical to the lateral members 18 of the tie 10 shown in FIGS. 1 and 2).

The tie 10*a* differs from the tie 10 in that the first masonry contact spacer elements 26*a* and 26*b* (shown in FIG. 4) have oppositely extending second masonry contact spacer elements 28*a* and 28*b* therewith, to define the mortar joint thickness T to either side of the reinforcing tie plane 20*a*. This results in the two longitudinal members 12*a* and 14*a* being disposed essentially centrally within the mortar joint J, and not contacting either of the masonry courses C1 or C2.

Figure 6:
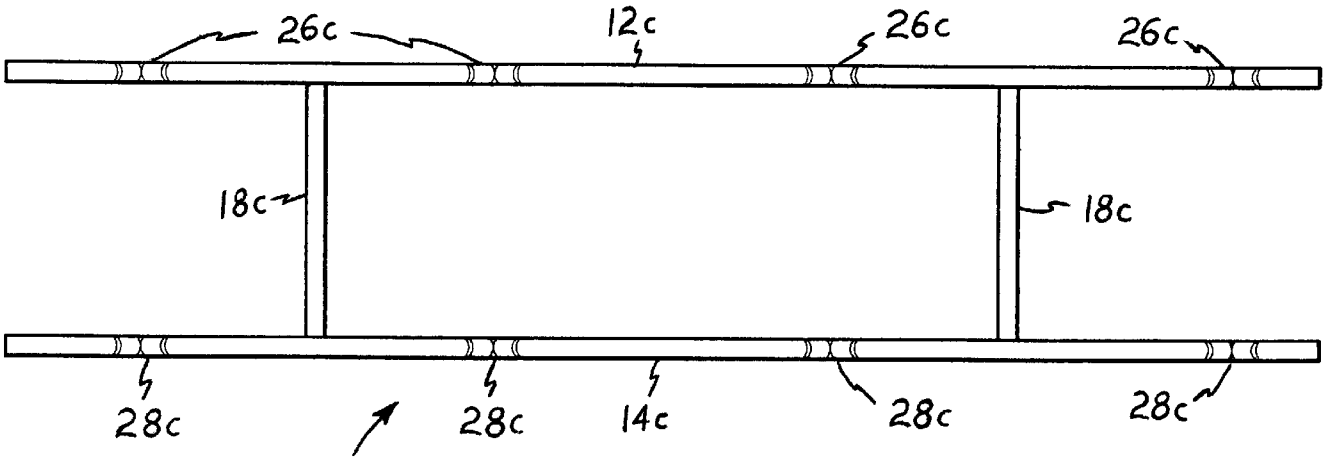
FIG. 6 is a top plan view of the first embodiment of the present reinforcing tie, having laterally aligned spacer elements.
Figure 7:
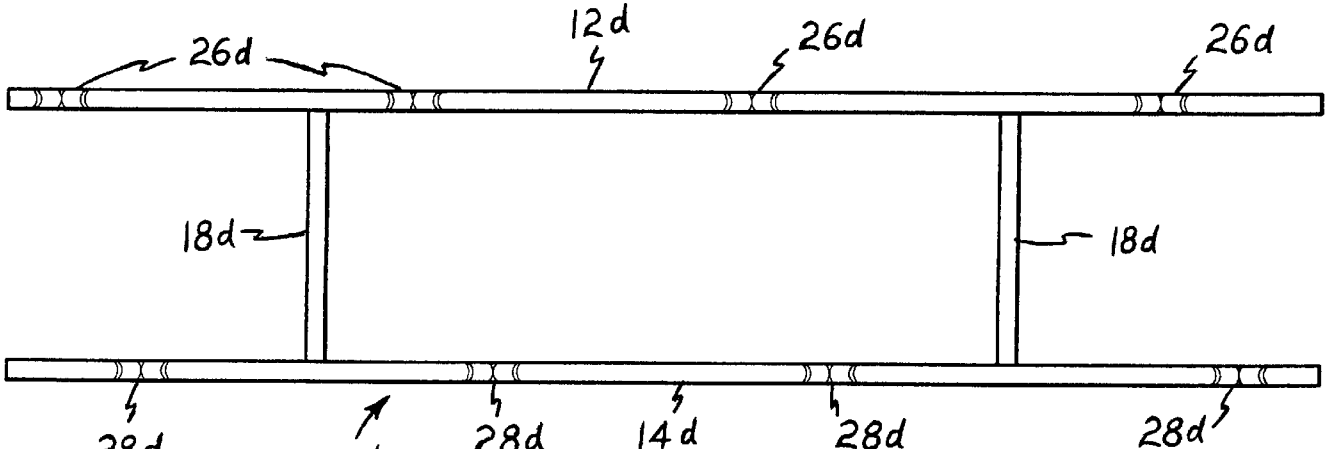
FIG. 7 is a top plan view of an alternative embodiment, showing laterally staggered spacer elements.

The spacing elements or masonry course contact means of the present masonry reinforcing and joint spacing tie may take on any of a wide number of different forms and variations, as desired. FIGS. 6 and 7 illustrate plan views of two further alternative embodiments, designated as reinforcing ties 10*c* and 10*d*. The two ties 10*c* and 10*d* each include a first longitudinal member, respectively 12*c* and 12*d*, and a second longitudinal member, respectively 14*c* and 14*d*, with the respective longitudinal members being interconnected by a series of lateral crossmembers, respectively 18*c* and 18*d*. Each longitudinal member includes a series of widely separated masonry course spacer elements therealong, respectively 26*c* and 28*c* for the tie 10*c* and 26*d* and 28*d* for the tie 10*d*.

The two ties 10*c* and 10*d* differ from one another in that the corresponding spacer elements 26*c* and 28*c* of the tie 10*c* are disposed laterally parallel to one another, while the spacer elements 26*d* and 28*d* of the tie 10*d* are laterally staggered relative to one another. These relationships are not critical to the function of the present invention, but merely illustrate that it is not critical that the spacer elements of each longitudinal member have any specific relationship to one another. It should also be noted that these spacer elements may be evenly spaced longitudinally along their respective longitudinal members, as in the first three spacer elements along each longitudinal member of the ties of FIGS. 3 and 4, or may be unevenly spaced, as in the longer gaps between the third and fourth spacer elements.

Figure 8:
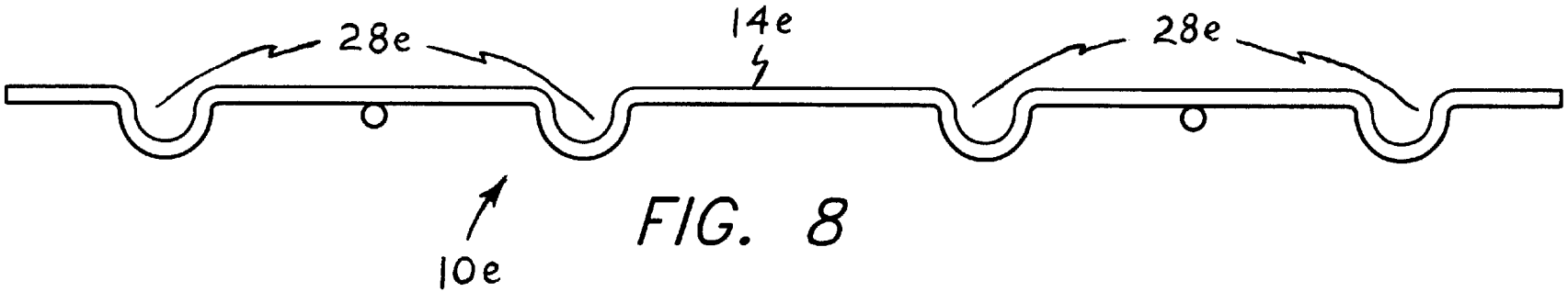
FIG. 8 is a side elevation view of yet another embodiment having generally U-shaped spacer elements.
Figure 9:
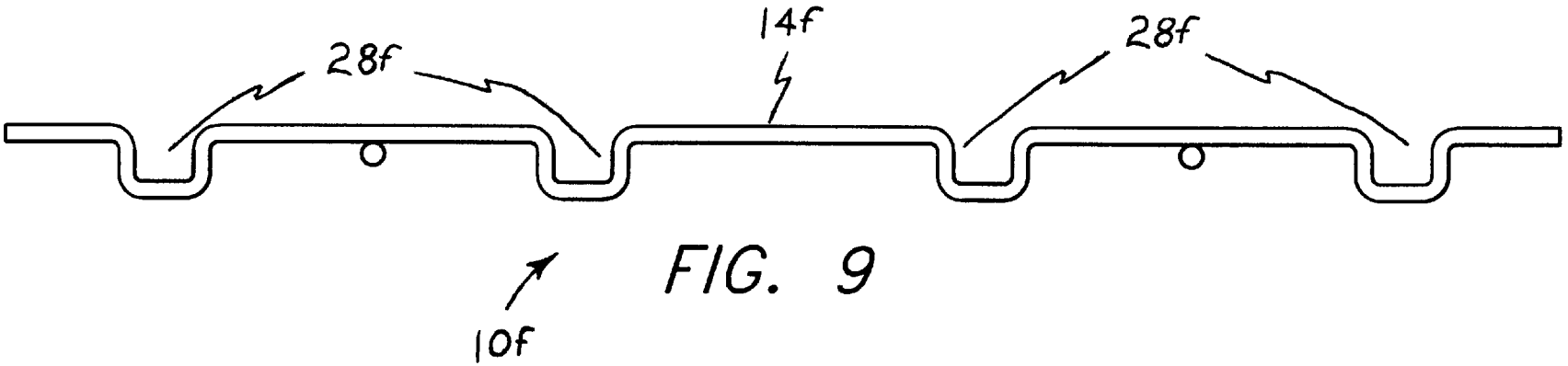
FIG. 9 is a side elevation view of a further embodiment having generally squared spacer elements.

While the reinforcing tie 10 of FIGS. 1 and 2 illustrate generally V-shaped masonry course contact or spacing elements 26 and 28, it must be noted that the specific shape of these spacing elements is not critical to the function of the present invention, so long as they are bent from the metal rod of the longitudinal members so as to extend generally normal to the plane of the tie assembly. FIGS. 8 and 9 illustrate side elevation views of further reinforcing tie embodiments, designated as ties 10*e* and 10*f*, having spacer elements of differing shapes. The reinforcing tie 10*e* of FIG. 8 has a series of generally U-shaped course spacer elements 28*e* formed along the visible longitudinal member 14*e*, while the reinforcing tie 10*f* of FIG. 9 has a series of generally square, or rectangular, spacer elements 28*f* formed along the longitudinal member 14*f*. (The second longitudinal member 14*e*, 14*f* and corresponding spacer elements 28*e*, 28*f* are shown in the side elevation views of FIGS. 8 and 9, as these are not cross sectional views.) Other alternative spacer configurations may be provided as desired, so long as the resulting height or thickness of the reinforcing tie is equal to the desired mortar joint thickness of the masonry construction with which the present tie is used.

Figure 10:
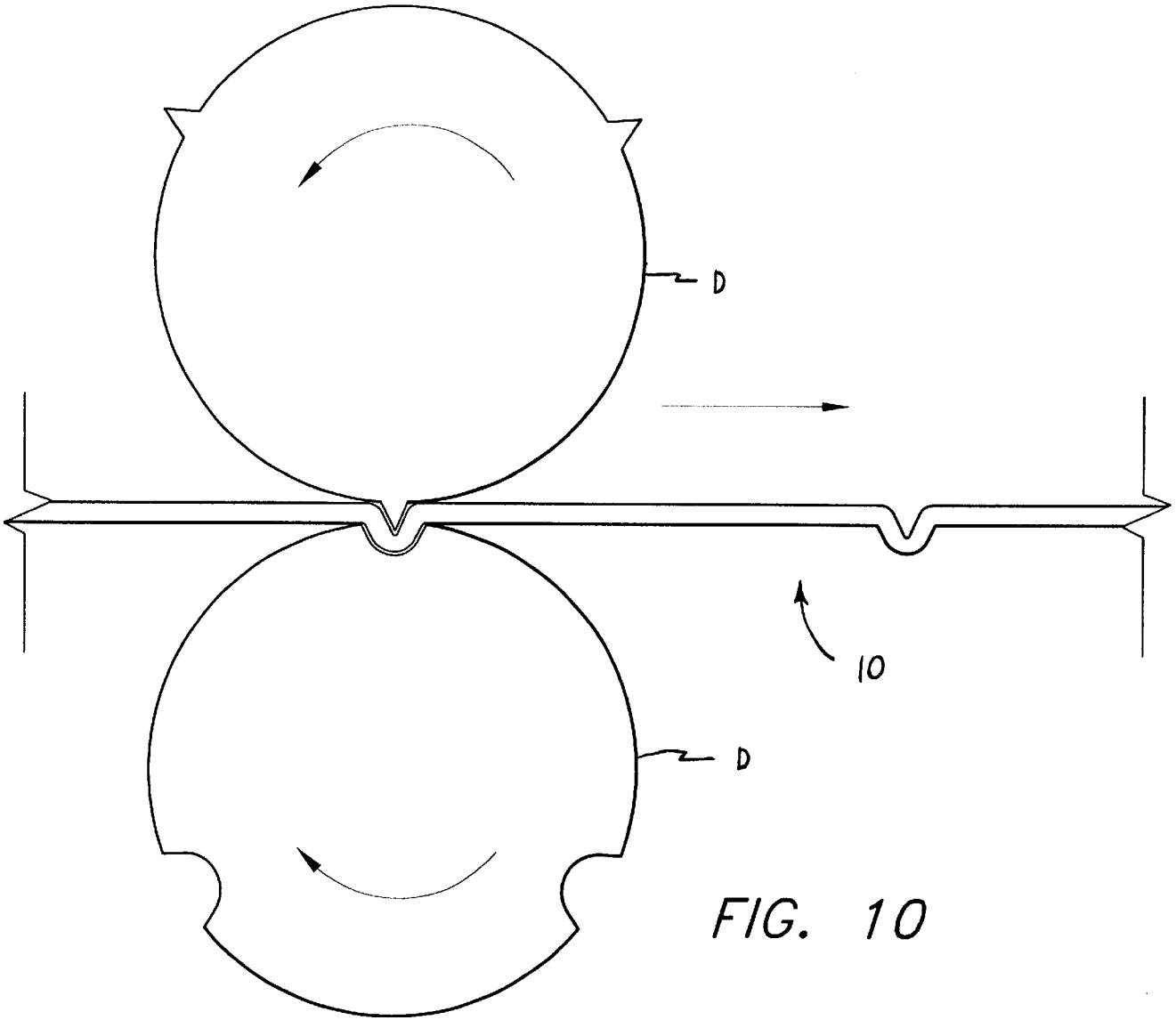
FIG. 10 is a schematic elevation view of a roller forming means for shaping the spacer elements of the present tie.

The present reinforcing tie embodiments may be manufactured conventionally, with the additional step of forming the spacing elements along the two parallel longitudinal members. This may be easily accomplished at the time of manufacture, by passing the ties through a pair of roller dies D, as shown in FIG. 10, or otherwise stamping or forming the spacing elements in the ties as desired.

In conclusion, the present masonry reinforcing and course spacing ties provide numerous advantages in masonry construction for the amateur worker or other persons having difficulty in forming precise mortar joints between courses of masonry elements. The masonry worker need only start with a level footing for the structure to be constructed, place a reinforcing tie on the footing, apply mortar over the reinforcing tie, and place a line of bricks or blocks atop the fresh mortar, tapping each masonry element downwardly until it is resting atop the course spacer means of the tie. As all of the spacer elements define precisely the same height for the reinforcing tie, and thus thickness for the mortar joint when the masonry elements are placed atop the course contacts of the reinforcing tie, the resulting joint is automatically set at the proper and precise thickness desired. Subsequent courses of masonry are constructed in the same manner, with one or more of the present reinforcing ties being placed atop each newly laid course before the next higher course is placed thereon. Accordingly, the present masonry reinforcement tie and course joint spacing tie greatly facilitates the construction of masonry walls and other structures, saving considerable time over conventional means used to assure that horizontal masonry joints are precisely formed. At the same time, the present reinforcing tie provides the reinforcement for such structures which is generally required by most authorities in such construction. The twofold function of the present tie thus provides a significant improvement over earlier such devices of the related art.

It is to be understood that the present invention is not limited to the embodiments described above, but encompasses any and all embodiments within the scope of the following claims.

I claim:

1. A masonry reinforcing tie for installing in a mortar joint between two vertically adjacent courses of masonry blocks during construction, said reinforcing tie consisting essentially of:

a first metal rod and a second metal rod parallel to said first metal rod, each said metal rod having a length and a circular cross section;

a plurality of metal rod lateral crossmembers, each of said crossmembers having a circular cross section and being permanently joined to each said metal rod, with each said metal rod and said plurality of lateral crossmembers defining a reinforcing tie plane having a first side and a second side opposite said first side;

each said metal rod having a plurality of bend portions integrally formed and evenly spaced along the length thereof, wherein said bend portions of each said metal rod depend downward from the first side and extend upward from the second side of said reinforcing tie plane.

2. The masonry reinforcing tie according to claim 1, wherein said bend portions of each said metal rod are laterally parallel relative to one another.

3. The masonry reinforcing tie according to claim 1, wherein said bend portions of each said metal rod are laterally staggered relative to one another.

* * * * *